US006513806B2

(12) United States Patent
Yui

(10) Patent No.: US 6,513,806 B2
(45) Date of Patent: Feb. 4, 2003

(54) RECORDING DEVICE FOR CARDS

(75) Inventor: Kenichi Yui, Kofu (JP)

(73) Assignee: Nisca Corporation, Yamanashi-ken (JP)

( * ) Notice: Subject to any disclaimer, the term of this patent is extended or adjusted under 35 U.S.C. 154(b) by 129 days.

(21) Appl. No.: 09/805,283

(22) Filed: Mar. 13, 2001

(65) Prior Publication Data

US 2002/0036376 A1 Mar. 28, 2002

(30) Foreign Application Priority Data

Sep. 28, 2000 (JP) ..... 2000-296171

(51) Int. Cl.[7] ..... B42D 15/10
(52) U.S. Cl. ..... 271/297
(58) Field of Search ..... 271/297; 399/110

(56) References Cited

U.S. PATENT DOCUMENTS 6,170,822 B1 * 1/2001 Kato et al. ..... 271/298

FOREIGN PATENT DOCUMENTS

| | | | | |
|---|---|---|---|---|
| JP | 3-262651 | * 11/1991 | ..... | B41J/2/32 |
| JP | 3-262664 | * 11/1991 | ..... | B41J/13/00 |
| JP | 9-131944 A | 5/1997 | | |
| JP | 10-71648 A | 3/1998 | | |
| JP | 11-10734 A | 1/1999 | | |
| JP | 11-268457 A | 10/1999 | | |
| WO | WO 96/19355 | * 6/1996 | ..... | B42D/15/10 |

* cited by examiner

*Primary Examiner*—Donald P Walsh
*Assistant Examiner*—Kenneth W Bower
(74) *Attorney, Agent, or Firm*—Pitney, Hardin, Kipp & Szuch LLP

(57) ABSTRACT

A recording device for recording information data such as images and characters on a recording card has one or more card transfer paths intersecting with a first transfer path extending from a card supply means at one or more intersection points. At the intersection point, there is placed a card turning means for turning the card or transferring the card between the card transfer paths. The technically ingenious arrangement of the card transfer paths and the card turning means enables materialization of making the compact, high-performance recording device capable of handling and processing the card effectively and producing various types of information cards such as credit card, license card and IC card with high efficiency.

16 Claims, 12 Drawing Sheets

RECORDING DEVICE FOR CARDS

BACKGROUND OF THE INVENTION

1. Field of the Invention

This invention relates to a device for recording information such as images and characters on a card or other recording medium. More particularly, this invention relates to a recording device having technically ingenious arrangement of several processing means including a printer, thus to make the device compact and improve the efficiency of processing and attain high degrees of freedom of design.

2. Description of the Prior Art

There have been widely used various types of card printers for printing or recording information such as images and characters on a recording card base of plastic to produce a credit card, license card, IC card and so on.

Usually, the recording device of this kind is composed of a card supplying means including a card stacker for storing one or more blank cards, a recording means such as a thermal printer, and a card discharging means for sending out a finished card. Such processing means are generally arranged along one card transfer path.

The recording part includes not only a printer, but also a magnetic encoder for magnetically recording information on the card and a coating means for coating a recording surface of the card with a protective film or a hologram film in order for protecting the recording surface and preventing falsification of the card. These components constituting the recording part are placed almost on the straight card transfer path.

Miniaturization of the recording device may be materialized by downsizing each component of the recording part and narrowing the space between the respective components. Specifically, to make the recording device compact, the recording part in the recording device may possibly be arranged close to the card stacker of the card supply part. That is to say, the card transfer path between the respective components of the recording device is generally designed to be short and straight so as to send the card from the card stacker of the card supply part to the printer in the recording part through the shortest distance even though there is disposed a supplementary implement such as a card cleaner between the card supply part and the recording part.

However, the printer generally having an ink ribbon cartridge and printing head, is large as always in volume and occupies much space. Also, the card supply part is intended to be large so as to store the blank cards as much as possible. Thus, the conventional recording device of this type was basically limited to be reduced in size because downsizing of the ink ribbon cartridge and the card stacker causes inconvenience of using the device with reduced efficiency.

Consequently, since the conventional card printer calls for a relatively long horizontal length for arranging the recording part and the card supply part on the straight card transfer path, the printer becomes, of necessity, large in its entire length and poor in degrees of freedom of design, and thus, it could not sufficiently be reduced in size.

Japanese Patent Application Publication HEI 9-131944 (A) discloses one possible way for preventing the card printer from being long. In this prior art card printer disclosed in the publication, the card transferring arrangement is formed of upper and lower paths extending horizontally in parallel, a card printer placed on the upper path, a magnetic encoder placed on the lower path, and a card transferring part including a pair of card turning means working cooperatively for transferring a card between the upper and lower paths.

However, the aforementioned prior art card printer may possibly be short in horizontal length, but cannot still be reduced in volume. Besides, the card moving length over which the card is transferred from the card supply part or printer on the upper path to the magnetic encoder on the lower path becomes longer, consequently to decrease the efficiency of processing.

Thus, there has been none of the compact card producing devices capable of processing the information card while transferring the card with high efficiency.

Also in Japanese Patent Application Publications HEI 10-71648(A), HEI 11-10734(A) and HEI 11-268457(A), there are disclosed devices for coating the recording face of a card with a protective film. These devices are all provided with a secondary card transfer path in addition to a main card transfer path, and, therefore, bulky in size, awkward to handle, and low in efficiency of transferring the card.

OBJECT OF THE INVENTION

An object of the present invention is to provide a recording device for information cards or other recording medium, which is made compact by rationally arranging a card recording means, coating means, card transferring mechanism and other processing means without affecting the performance of processing the card.

Another object of the invention is to provide a device capable of recording various information on both sides of a card-like recording medium and being stably operated with simple driving and controlling systems.

Still another object of the invention is to provide a recording device for information cards, which has technically ingenious arrangement of the constituents including a card supplying means, one or more recording means such as a printer for printing information on the card and a magnetic encoder, card transferring mechanism, a controller and other processing mechanisms such as a coating means for coating the card with a protective film or a hologram film.

Yet another object of the invention is to provide a versatile recording device capable of being easily joined to a secondary processing device.

SUMMARY OF THE INVENTION

To attain the object described above according to this invention, there is provided a recording device for cards, comprising a first transfer path on which a card supplying means is placed, second and third transfer paths intersecting with the first transfer path at one or more intersection points, at least one card turning means placed at the intersection point, and first and second processing means placed on the second and third transfer paths.

Each of the first, second and third transfer paths may made straight. These transfer paths may intersect at one intersection point so as to extend radially from the intersection point. In this case, only one card turning means may be disposed at the intersection point so as to transfer the card among the first, second and third transfer paths.

The section and third transfer paths may intersect at different points with the first transfer path. In the case of providing three card transfer paths intersecting at the different points, two card turning means are placed one at each intersection point. The second and third transfer paths may each intersect at right angles or different angles.

The card supplying means is placed at one end of the first transfer path, and a card discharging means may be placed at the other end of the first transfer path or on the other transfer paths.

The transfer paths may be incorporated in one casing or separate casings. By separately placing the first and second transfer paths and the third transfer path in the separate casings, a first unit including the second transfer path with the first processing means alone can be used independently of a second unit including the third transfer path with the second processing means. That is, in the case where the first processing means in the first unit has a function of printing information on the card, the first unit independent of the second unit can be used as a card printer. In the case where the second processing means in the second unit functions as a coating device for coating the card with a protective film, the second unit independent of the first unit can be attached to another card printer.

The structure of radiating the first, second and third transfer paths makes it possible to shorten the distances from the card turning means to the card supply part and the card discharge part, thus to make the recording device compact.

The recording device may further be provided with a fourth transfer path extending radially from the intersection point of the first and second transfer paths, on which a third processing means is disposed. The first and third processing means each may be a printer for printing characters and/or images on the card, a magnetic encoder for magnetically recording information on the card, or an IC writer. The card discharging means may be placed at one end of the first transfer path or the fourth transfer path.

There may further be disposed a fifth transfer path intersecting the first transfer path, on which a fourth processing means such as a different type of printer. The second, third and fifth processing means may be formed respectively in separate casings capable of being freely connected with one another.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

This invention relates to a recording device having functions of recording various information on a card-like recording medium and coating the recording surface of the recording medium with a protective film or a hologram film. The recording device of the invention has a technically ingenious arrangement of operating units for carrying out the aforesaid functions so as to be made compact.

With the device described hereinafter, various information such as characters and image patterns are recorded or printed on the recording surface of a card-shaped plastic base to make credit cards, license cards or identification IC cards, by way of example. The card-shaped place base is applied as a recording medium, but the sort and type of the card to be produced by the device of the invention should not be understood as being limited thereto.

Figure 1:
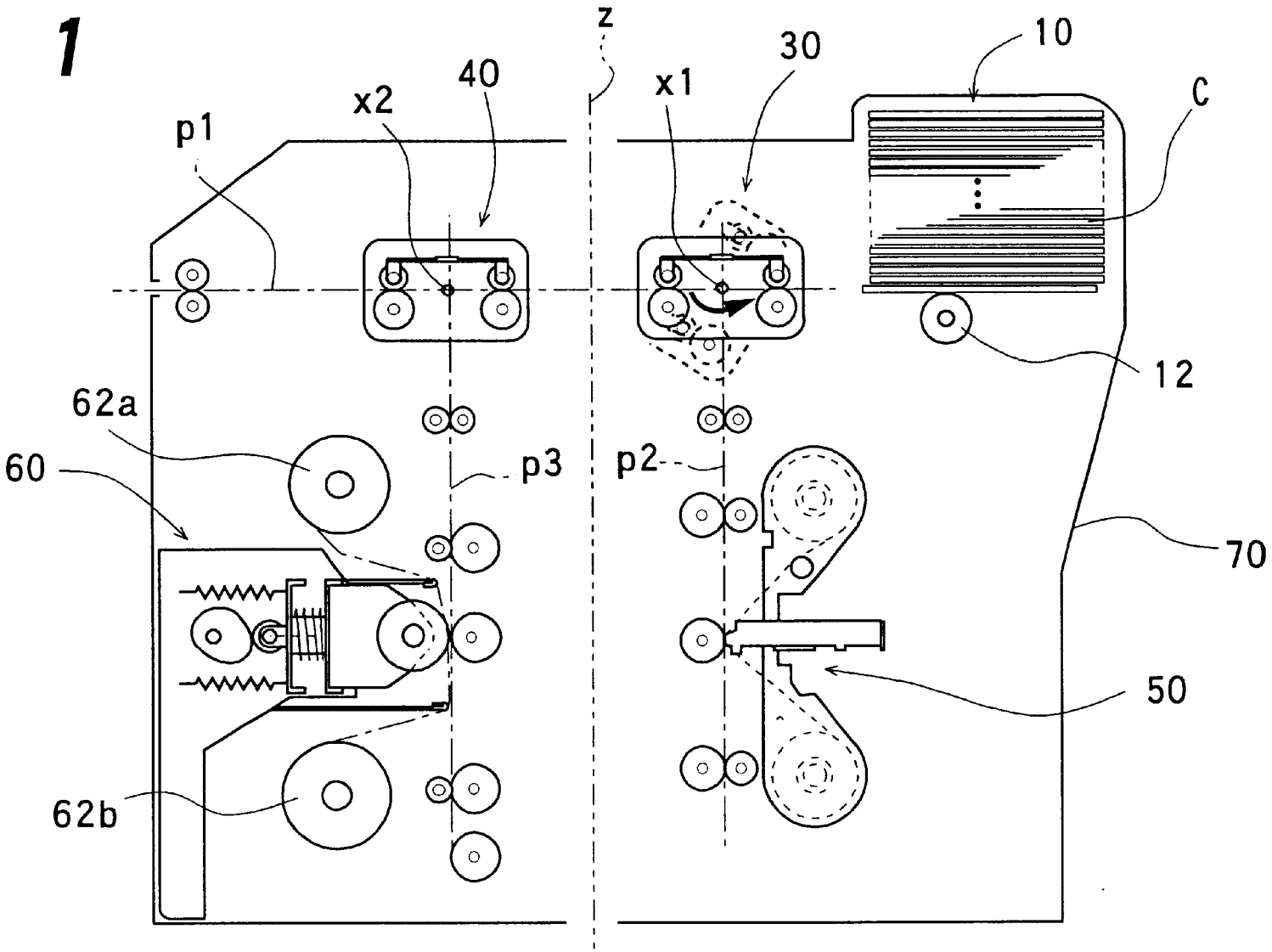
FIG. 1 is a conceptual front view schematically showing a basic structure of a recording device according to the present invention.

As shown conceptually in FIG. 1, the recording device of the invention comprises a first transfer path p1 extending from a card supplying means 10 to a card discharging means 20, a second transfer path p2 intersecting with the first transfer path p1, and a third transfer path p3 intersecting with the first transfer path p1, a first card turning means 30 placed at the intersection point x1 at which the first and second transfer paths p1 and p2 intersect with each other, and a second card turning means 40 placed at the intersection point x2 at which the first and third transfer paths p1 and p3 intersect with each other a first processing means 50 placed on the second transfer path p2, and a second processing means 60 placed on the third transfer path p3.

The aforementioned first, second and third transfer paths p1, p2 and p3, first and second card turning means 30 and 40, and first and second processing means 50 and 60 are incorporated in a casing 70. The casing 70 may be divided into two along a chain line z in FIG. 1. Incidentally, an embodiment in which the first and second processing means 50 and 60 are separately contained in casings 71 and 72 to form a first device unit A1 and a second device unit A2 is illustrated in FIG. 2.

Figure 2:
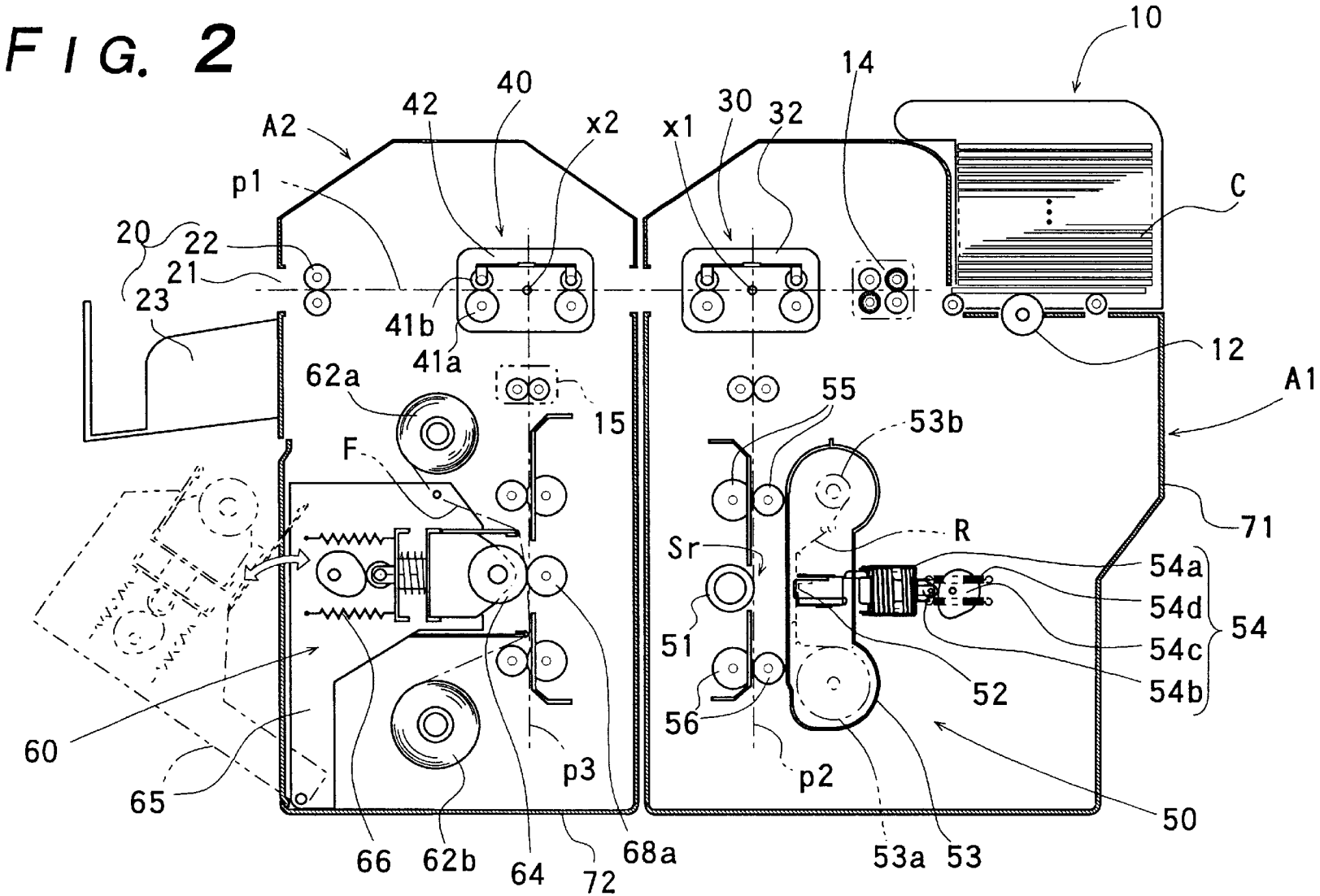
FIG. 2 is a schematic front view of a first embodiment of the recording device of the invention.

The first device unit A1 in FIG. 2 includes the first transfer path p1 extending nearly horizontally in the casing 71, the card supplying means 10 for storing and sending out blank cards (recording media) C to the first transfer path p1 one by one, the second transfer path p2 intersecting the first transfer path p1 at the intersection x1, the first card turning means 30 disposed at the intersection x1, and the first processing means 50 for recording information on at least one side of the card C fed from the card supplying means 10.

The second device unit A2 shown in FIG. 2 includes the first transfer path p1 continuously extending from the first device unit A1, the third transfer path p3 intersecting the first transfer path p1 at the intersection x2, the second card turning means 40 disposed at the intersection x2, the second processing means 60 for recording information on at least one side of the card C fed from the first device unit A1, and the card discharging means 20 for sending out the card C traveling along the first transfer path p1 to an external discharge stacker.

The card supplying means 10 in the first device unit A1 includes a card stacker 11 for stacking one or more blank card C, and a kick roller 12 for sending out the cards from the card stacker 11 one by one.

The card stacker 11 has a card outlet slot for allowing only one card to pass therethrough, so that the cards stacked in the card stacker 11 are sent out one by one through the card outlet slot to the first transfer path p1 by rotating the kick roller 12.

In the drawings, reference numeral 14 denotes a cleaner for cleaning the recording surface of the card sent out from the card stacker 11. The cleaner 14 illustrated as an example comprises a cleaning roller and a press roller, so as to remove a stain or dust from the card passing through between the cleaning roller and the press roller.

The first card turning means 30 placed at the intersection x1 of the first and second transfer paths p1 and p2 serves to send the card from the first transfer path p1 to the second transfer path p2 and vice versa and turn the card upside down so as to record information on either side of the card by use of the first processing means 50.

The first card turning means 30 comprises two sets of pinch rollers 31*a* and 31*b*, and a rotary frame 32 that is rotatable about the intersection x1 of the first and second transfer paths p1 and p2.

The pinch rollers 31*a* and 31*b* are in contact with each other on the first transfer path p1 when the rotary frame 32 is in its horizontal posture and on the second transfer path p2 when the rotary frame 32 is in its vertical posture. One of the paired pinch rollers 31*a* and 31*b* is a driving roller, and the other roller is a driven roller.

The rotary frame 32 and the pinch rollers 31*a* and 31*b* can be rotated simultaneously by operating a single driving system (not shown). However, when rotating the rotary frame 32 rotates in one card-feeding direction, the pinch rollers 31*a* and 31*b* rotate in the opposite card-feeding direction concurrently. With the structure in which the pinch rollers rotate in the opposite card-feeding direction to that in the rotary frame 32, the card held between the pinch rollers 31*a* and 31*b* rotating simultaneously with the frame 32 is not shifted in the lengthwise direction. By adopting two independent driving systems for rotating the frame and the pinch rollers respectively, the pinch rollers 31*a* and 31*b* need not be rotated in the opposite card-feeding direction to that in which the frame 32 rotates.

The first processing means 50 incorporating a thermal transfer printer comprises a platen roller 51 placed at a recording position Sr on the second transfer path p2, a thermal head 52 movable back and forth relative to the platen roller 51, and an ink ribbon cartridge 53 containing an ink ribbon R coated with thermal transfer ink. Card feeding rollers 55 and 56 are disposed on the second transfer path p2 before and behind the recording position Sr.

The ink ribbon R contained in the ink ribbon cartridge 53 is fed from a ribbon supply reel 53*a* to a ribbon rewinding reel 53*b* through between the platen roller 51 and the thermal head 52. When thermally transferring information such as characters and patterns onto the recording surface of the card, the thermal head 52 moves toward the platen roller 51 and comes in contact with the platen roller through the ink ribbon R. By selectively driving heating elements of the thermal head 52, desired information can be depicted on the card moving along the second transfer path p2 with thermal transferable ink applied onto the ink ribbon.

Reciprocating motion of the thermal head 52 movable back and forth relative to the platen roller 51 is fulfilled by using a reciprocating mechanism 54 comprising a holder 54*a* for detachably holding the thermal head 52, a follower 54*b* mounted on the holder 54*a*, a non-circular cam 54*c* which rotates while being in contact with the follower 54*b*, and a spring 54*d* for thrusting the follower 54*b* against the cam 54*c*. However, the reciprocating mechanism is not indispensable to the invention and therefore should be understood as being limitative.

The thermal transfer recording method and the thermal transfer printer as described above are not novel in this field of art and may be easily accomplished on the basis of conventional art. That is, any type of thermal printers such as a thermal fusing type printer and a sublimation type printer may be used according to the purposes for which they are used.

The expected operation of the first device unit A1 as noted above can easily be accomplished by using a simple controlling system. Although the invention does not contemplate imposing any limitation on the mechanism for operating the recording device, the kick roller 12 in the card supplying means and the rotary frame 32 of the card turning means 30 can be driven by a single motor with an adequate electromagnetic clutch.

The device employs another driving source for rotating the cam 54*c* of the reciprocating mechanism 54 for moving the thermal head 52, but the cam 54*c* may be driven by the driving system for driving the other components with the aid of an electromagnetic clutch without using the driving source only for the cam 54*c*. The time required for processing each card can be shortened by sending the next card from the card stacker 11 to the position close to the card turning means 30 while processing the preceding card at the first processing means 50 on the second transfer path p2. For this purpose, independent driving mechanisms may be provided on the respective transfer paths.

The second card turning means 40 in the second device unit A2 is substantially the same as the first card turning means 30 in the first device unit A1. That is, the second card turning means 40 comprises two sets of pinch rollers 41*a* and 41*b*, and a rotary frame 42 rotatable about the intersection x2 of the first and third transfer paths p1 and p3. Since the second card turning means 40 is operated in the same manner as the first card turning means 30 as described above, the description of the operation of the second card turning means 40 is omitted below to avoid repetition.

In the illustrated embodiment, the second processing means 60 disposed on the third transfer path p3 in the second device unit A2 is a coating unit for applying a transparent or colored protective film or a hologram film onto the recording surface of the card recorded with the desired information in order for protecting the recording surface or preventing alteration of the information recorded on the card. Since the card can be turned by the card turning means 40, the coating can be applied to either or both of the recording surfaces of the card.

In the second processing means 60 serving to coat the card with the protective film, a coating film F is fed from a coating film supply roll 62*a* to a coating film rewinding roll 62*b* and pressed halfway between the rolls 62*a* and 62*b* against the recording surface of the card by a heating roller 64. Namely, only when the ink on the coating film F is thermally transferred to the card C, the heating roller 64 is moved forward by a push means 66 to press the coating film F against the card.

Figure 3:
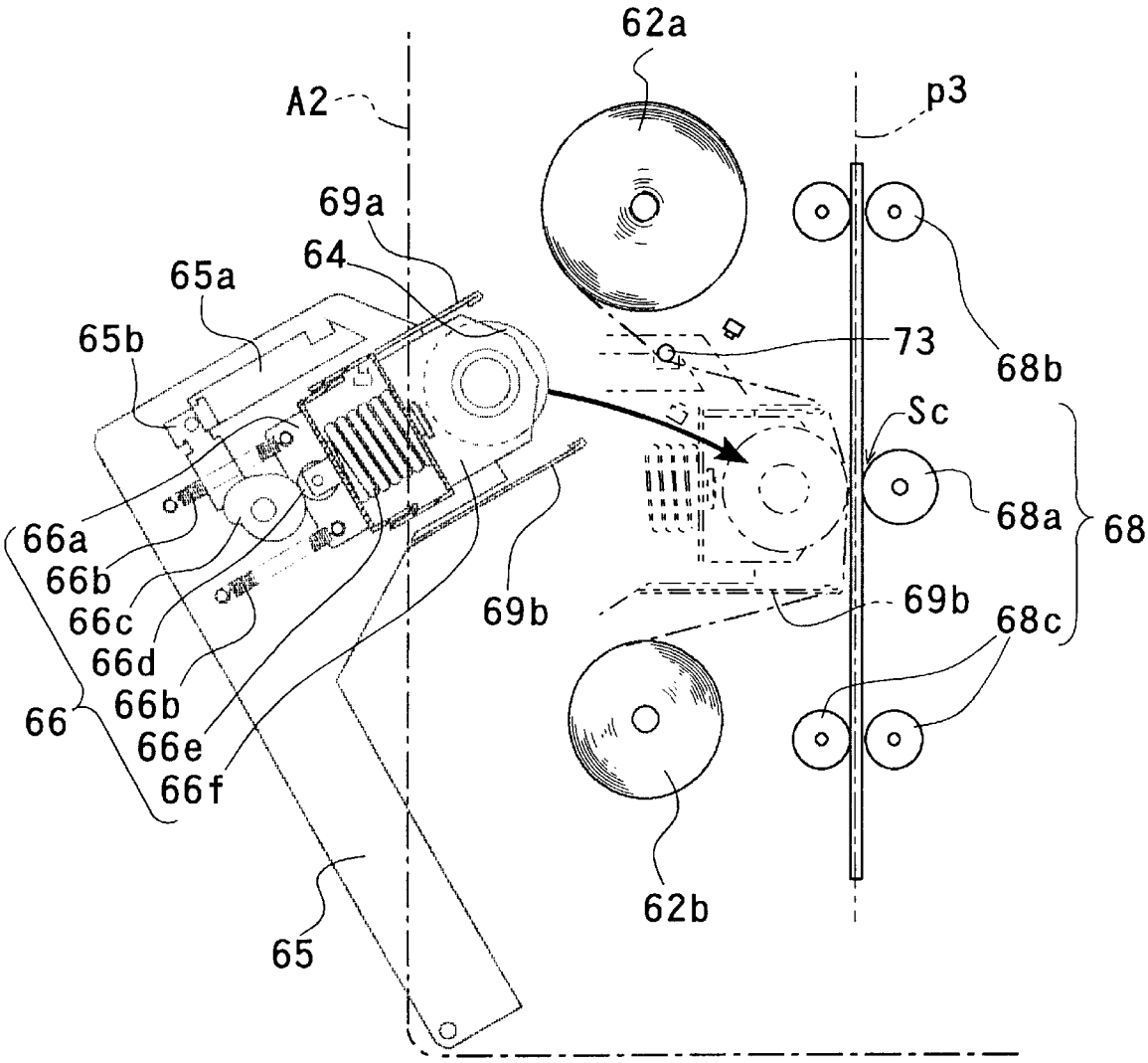
FIG. 3 is a schematic front view illustrating a coating means in the device of FIG. 2.

The coating film supply roll 62*a* and the coating film rewinding roll 62*b* are set either above or below a coating position Sc in the second device unit A2. By moving the united heating roller 64 and push means 66 away from the coating position Sc as shown in FIG. 3, the coating film supply roll 62*a* and the coating film rewinding roll 62*b* can be replaced, and the device can be subjected to maintenance with ease. To serve this function, the casing 72 is provided with a side cover, which holds the push means 66 and heating roller 64 and can open sideways as depicted by an imaginary line in FIG. 2.

Along the third transfer path p3, a card transfer means 68 is arranged, which includes a platen roller 68*a*, and capstan rollers 68*a* and 68*b* for moving the card at a constant speed.

The push means 66 for moving back and forth the heating roller 64 relative to the platen roller 68*a* placed at the coating position Sc comprises a holding member 66*a* slidably supported by springs 66*b* on a supporting frame 65, a non-circular cam 66*c* rotatably mounted on the supporting frame 65, a follower 66*d* mounted on the holding member 66*a* for moving back and forth the holding member 66*a*, following the rotating cam 66*c*, and a bracket 66*f* which rotatably holds the heating roller 64 and connected to the holding member 66*a* through a resilient member 66*e*.

By rotating the cam 66*c* at the operation position indicated by an imaginary line in FIG. 3, the follower 66*d* moves toward the coating position Sc against the springs 66*b*, consequently to bring the heating roller 64 into press contact with the card C through the coating film F with the aid of the resilient member 66*e*.

Accordingly, by pressing the heating roller 64 being heated against the card C through the coating film F while rewinding the coating film F at the same speed as that at which the card is moved along the third transfer path p3, the desired coating can be fulfilled on the card.

The bracket 66*f* is provided with a guide plate 69*a* and a releasing plate 69*b* for facilitating locating the coating film F at the prescribed position defined on the third transfer path p3 upon setting the coating film rolls 62*a* and 62*b* within the second device unit A2. That is, the coating film F, which is stretched tight at distance from the coating position Sc when the rolls 62*a* and 62*b* are set in the second device unit A2, is located at the coating position Sc by thrusting the supporting frame 65 into the second device unit A2 as shown by the arrow in FIG. 3, to allow the guide plate 69*a* and releasing plate 69*b* to push the coating film F to the prescribed coating position.

The supporting frame 65 has a hook 65*a* removably engaged with a guide pin 73 for guiding the coating film F traveling from the supply roll 62*a* to the rewinding roll 62*b* so as to be secured within the second device unit A2. The hook 65*a* has an unhooking lever 65*b* energized by a coil spring or the like. By operating the unhooking lever 65*b*, the hook 65*a* is released from the guide pin 73, so that the supporting frame 65 can be drawn out sideways from the second device unit A2 along with the push means 66.

The structure of the second device unit (coating unit) A2 facilitates to be subjected to maintenance and perform the work of replacing the coating film supply and rewinding rollers.

On the third transfer path p3, there is mounted a cleaner 15 which is substantially the same as the cleaner 14 mounted on the first transfer path p1. The cleaner 15 comprises a cleaning roller and a press roller, so as to remove a stain or dust from the card passing through between the cleaning roller and the press roller.

The card discharging means 20 in this embodiment is positioned at the opposite end of the first transfer path p1 to the card supplying means 10. The card discharging means 20 has an opening 21 formed on the first transfer path p1, discharge rollers 22 near the opening 21, and a card catch stacker 23 outside the opening 21. However, these components constituting the card discharging means 20 are by no means limited thereto.

The driving elements in the second device unit A2 can easily be operated by a simple controlling system. The driving mechanisms provided on the first and third transfer paths p1 and p3, card turning means 40 with the rotary frame 42 and second processing means 60 may be actuated by one or more motors and controlled by using adequate transmission means including an electromagnetic clutch, but these components or controlling system are not limited thereto.

Although in this embodiment, the first device unit A1 and second device unit A2 are formed by the respective casings 71 and 72 and detachably joined with each other by using a joint mechanism or the like, the recording device of the invention are not always be divided into the device units A1 and A2, as touched on briefly earlier. Therefore, the aforenoted joint mechanism should not be understood as being limitative.

The consecutive operation of the card recording process and coating process in the recording device constituted by the aforementioned components will be described hereinafter with reference to FIG. 4A to FIG. 4G.

Figure 4A:
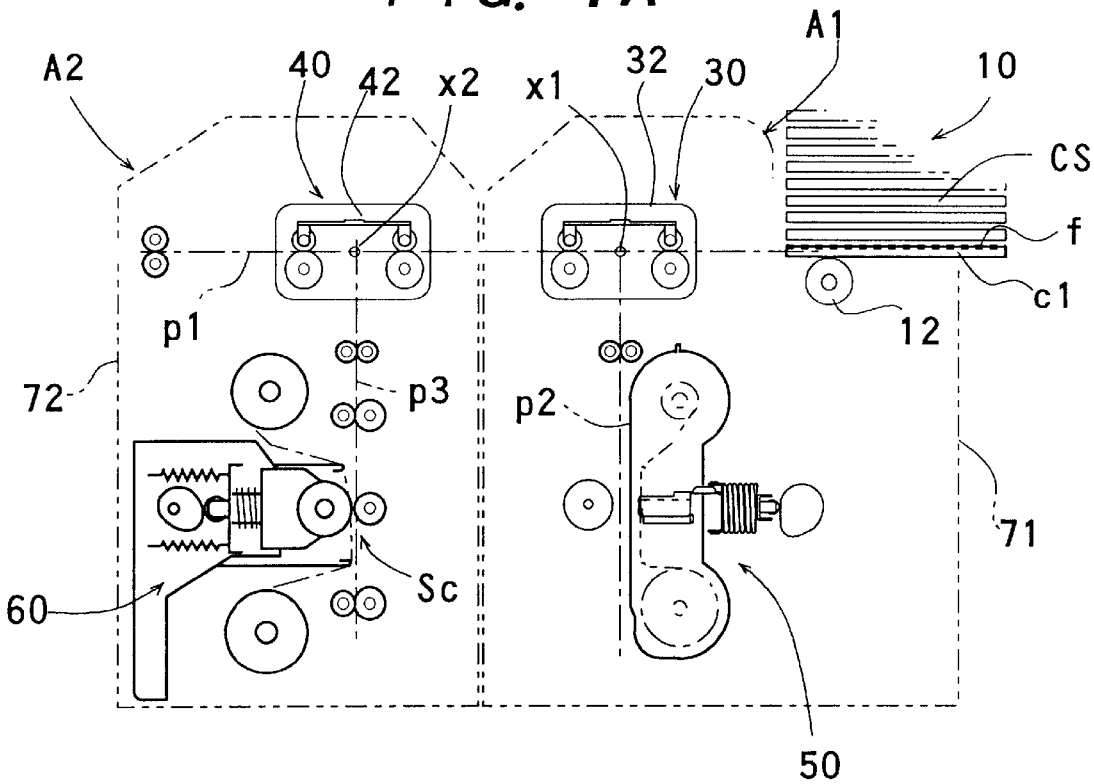
FIG. 4A through FIG. 4G are explanatory diagrams illustrating a process in which card recording and coating are performed in the device of FIG. 2.

FIG. 4A shows the initial state in which blank cards are loaded into the card stacker 11 of the card supplying means 10. When receiving instructions to record information on a card, the kick roller 12 starts to rotate to send out the lowermost blank card c1 from the card stacker 11 to the first transfer path p1. In the drawings, the recording surface f (upper side) of the card c1 to be printed with the information is depicted by a thick dotted line in an easily understandable manner.

Figure 4B:
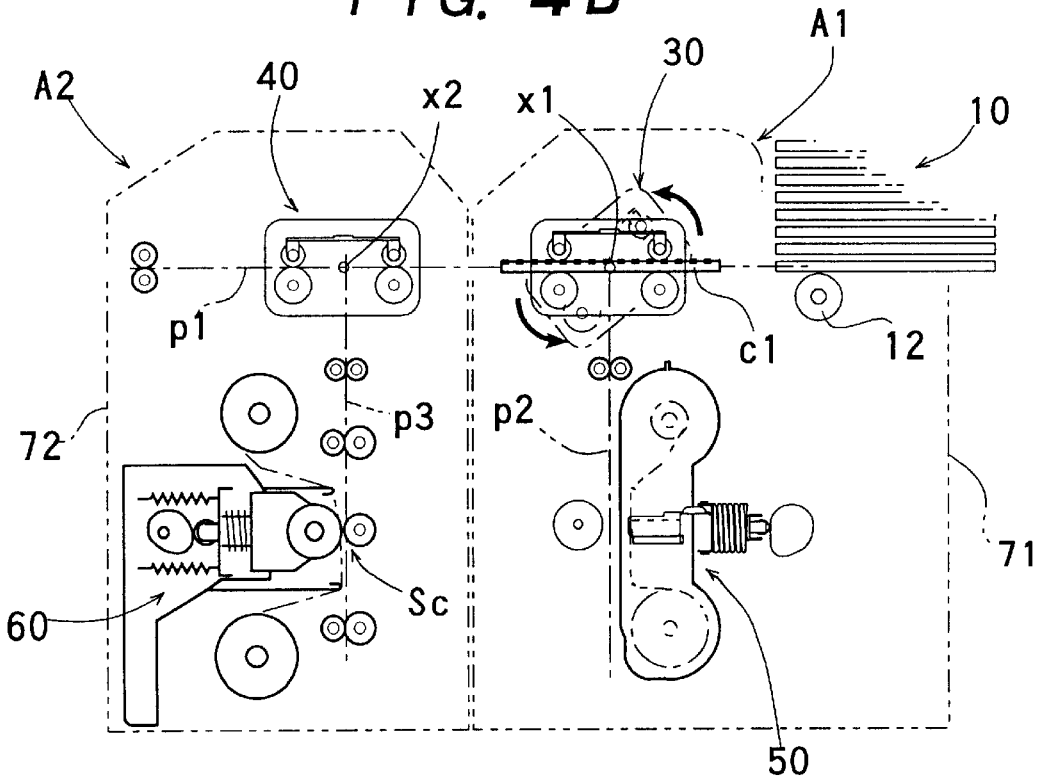

When the center of the card c1 being forwarded along the first transfer path p1 arrives at the center of the rotation center (intersection x1) of the first card turning means 30, the rotary frame 32 is turned with the card c1 held between the pinch rollers 31*a* and 31*b* (FIG. 4B). In the illustrated embodiment, the card is turned with the rotary frame 32 counterclockwise for 270 degrees, assuming that the card surface f should be printed with information, but the direction of rotation of the rotary frame 32 is by no means limited thereto. However, since it is desirable to drive the rotary frame 32 in one direction in order for simplifying the driving system therefor, the rotary frame 32 is first rotated 270 degrees in this embodiment.

Figure 4C:
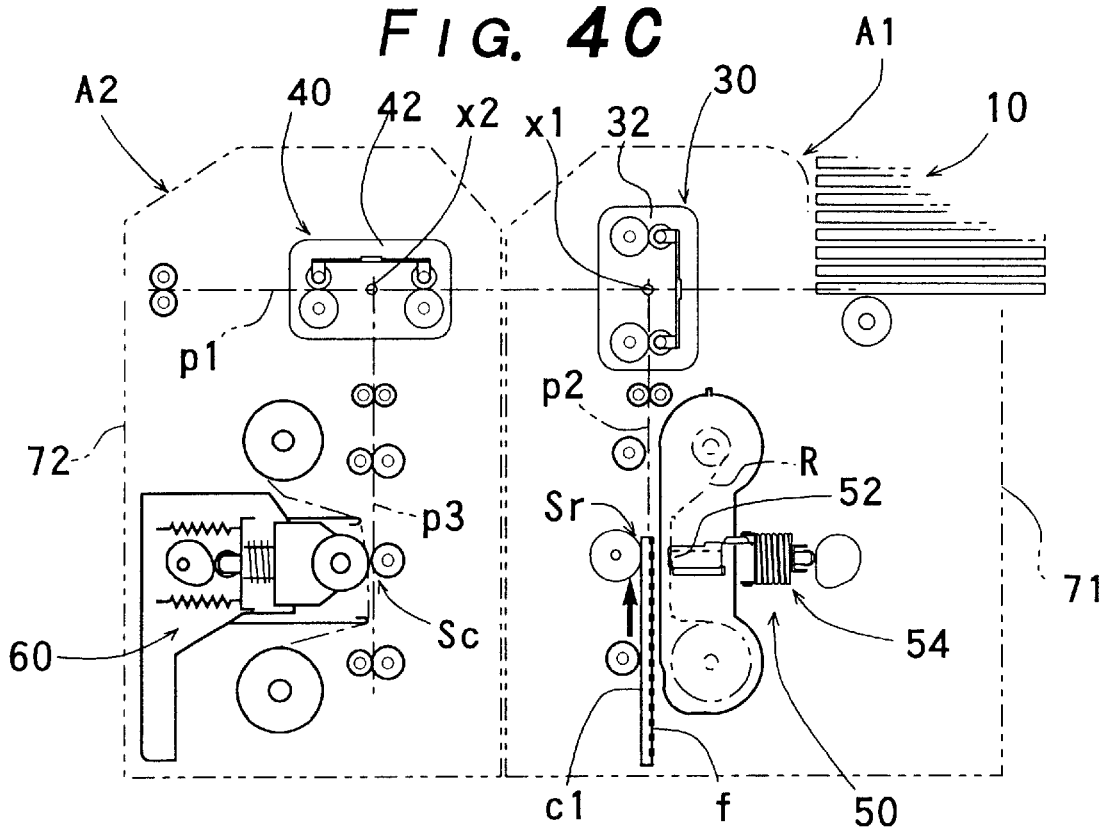

When the card c1 being turned 270 degrees is aligned with the second transfer path p2 as shown in FIG. 4C, the card turning means 30 is stopped, and the pinch rollers 31*a* and 31*b* are rotated to forward the card c1 toward the first processing means (printer) 50. The forward movement of the card c1 is finished when the tail end (upper end in FIG. 4C) of the card c1 arrives at the recording position Sr.

After this, printing of the information such as characters or image patterns onto the card is carried out. First, the reciprocating mechanism 54 of the printer 50 is operated to move the thermal head 52 toward the card c1 and allow the thermal head 52 to press the ink ribbon R against the recording surface f of the card. Then, while moving the card c1 toward the card turning means 30 (in the direction shown by the arrow in FIG. 4C) in the state of pressing the ink ribbon R against the card, the heating elements of the thermal head 52 are selectively driven to thermally transfer the ink of the ink ribbon onto the recording surface f of the card c1. Consequently, the desired image is printed on the card.

Figure 4D:
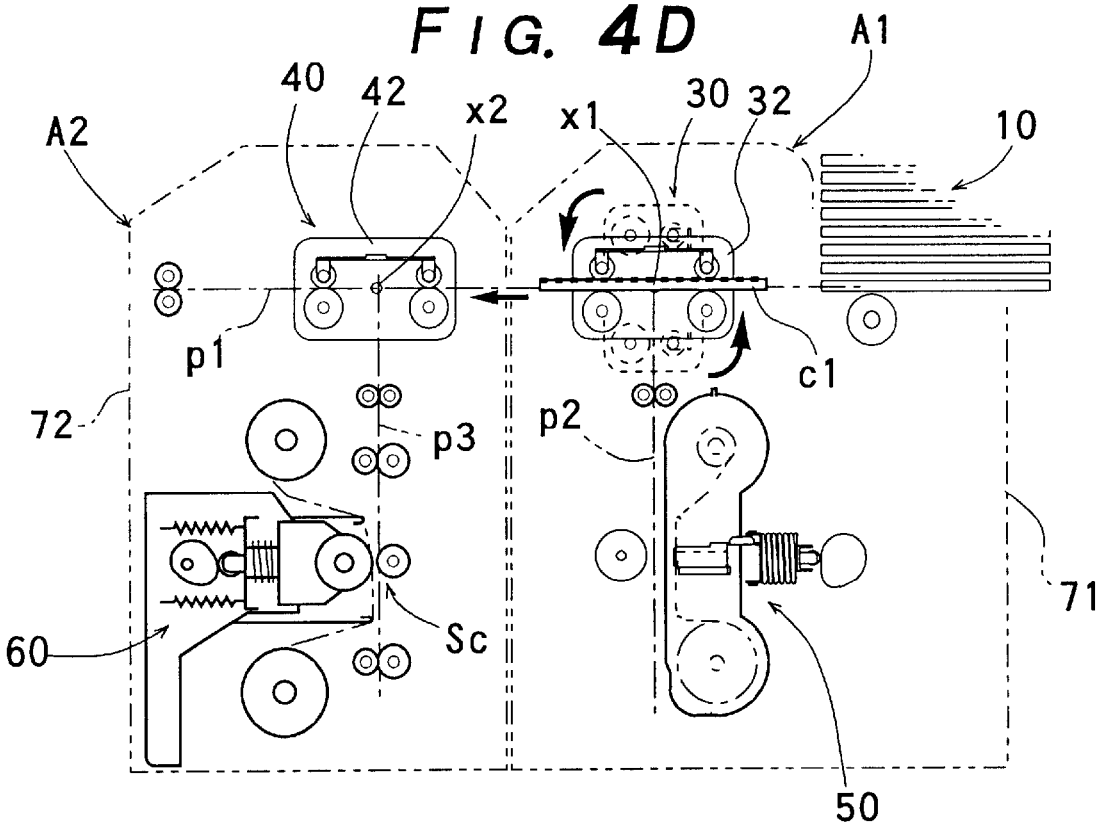

At the time of finishing the printing of the information onto the card, the card is caught by the rotating pinch rollers 31*a* and 31*b* of the card turning means 30 as shown by a dotted line in FIG. 4D and moved to the center of the card turning means 30. Thereafter, the rotary frame 32 of the card turning means 30 is rotated 90 degrees counterclockwise as shown by the arrow in FIG. 4D, to turn the recording surface f of the card c1 upward. Then, the card c1 in its horizontal posture is forwarded toward the second device unit A2 along the first transfer path p1.

In the second device unit A2, the recording surface f on which information is recorded in the first device unit A1 is coated with the protective film F.

When the card c1 sent to the second device unit A2 arrives at the center of the rotation center (intersection x2) of the second card turning means 40, the rotary frame 42 is turned with the card c1 held between the pinch rollers 41*a* and 41*b*. The turning of the card with the rotary frame 42 is carried out in the same manner as the first card turning means 30 as described above, and therefore, the description of the operation and function of the second turning means 40 is omitted.

Figure 4E:
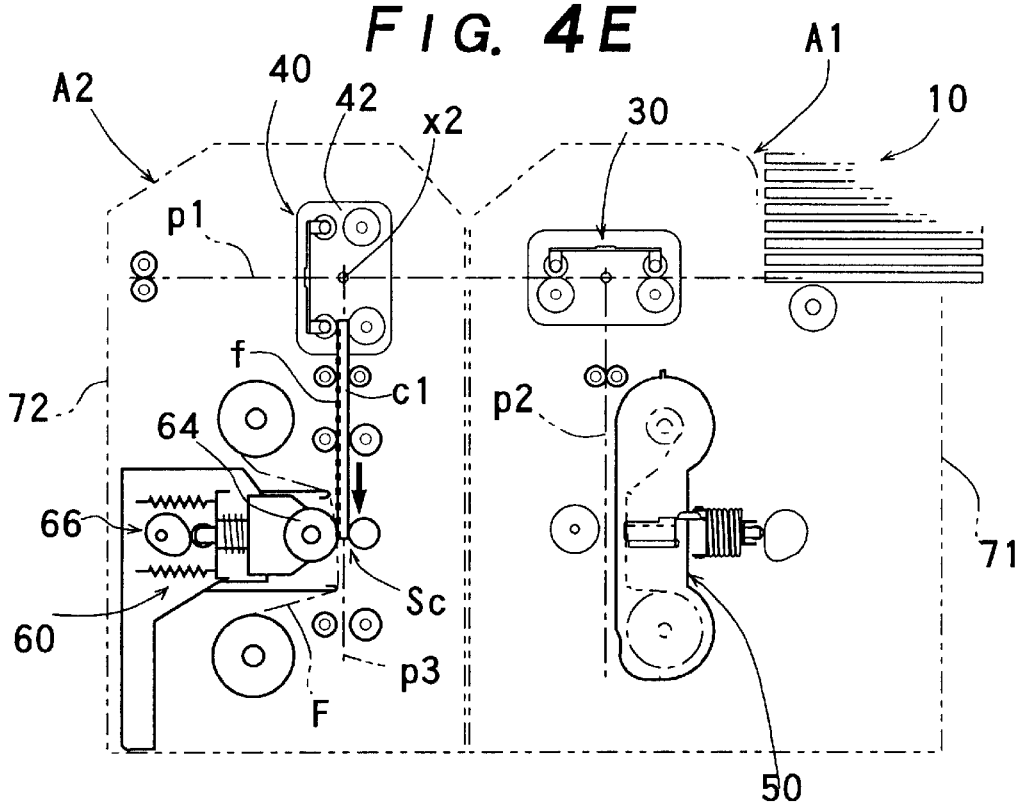
Figure 4F:
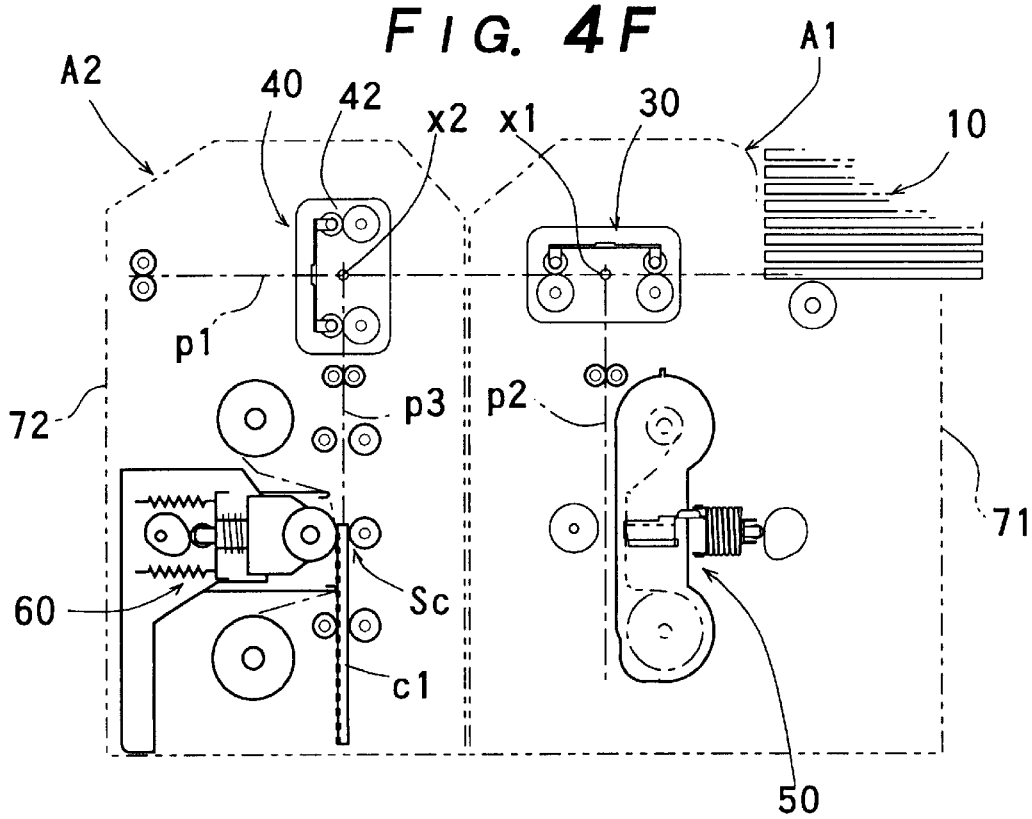

When the card c1 being turned with the rotary frame 42 is aligned with the third transfer path p3 as shown in FIG. 4E, the second card turning means 40 is stopped, and the pinch rollers 41*a* and 41*b* are rotated to forward the card c1 toward the second processing means (coating unit) 60. The forward movement of the card c1 is finished when the tail end (upper end in FIG. 4F) of the card c1 arrives at the coating position Sc.

Next, the card is coated with the film F in the following manner. The push means 66 of the coating unit 60 is operated to move the heating roller 64 toward the card. Then, while heating the heating roller 64 pressing the film F against the recording surface f of the card, the card is moved downward (in the direction of the arrow in FIG. 4E), consequently to coat the card with the film F.

Upon completion of coating the card with the protective film, the push means 66 of the second processing means 60 is operated to move the heating roller 64 away from the card. Then, the card transfer means 68 is rotated in the reverse direction to forward the card to between the pinch rollers 41*a* and 41*b* of the second card turning means 40 until the card c1 arrives at the center of the second card turning means 40 as shown by a dotted line in FIG. 4G. Thereafter, the rotary frame 42 of the second card turning means 40 rotates clockwise 90 degrees so as to place the card with the recording surface f upward. The card c1 is finally forwarded toward the card discharging means 20 along the first transfer path p1 and sent out into the card catch stacker 23 as indicated by the arrow in FIG. 4G.

The desired information recording and protective coating on one surface of the card are carried out in the foregoing manner. In case of performing the information recording and protective coating on the other surface of the card, the card in FIG. 4D may be turned 180 degrees at the first card turning means 30 and sent to the printer 50 as shown in FIG. 4C. Thus, the desired information recording on both surfaces of the card can be fulfilled.

Figure 4G:
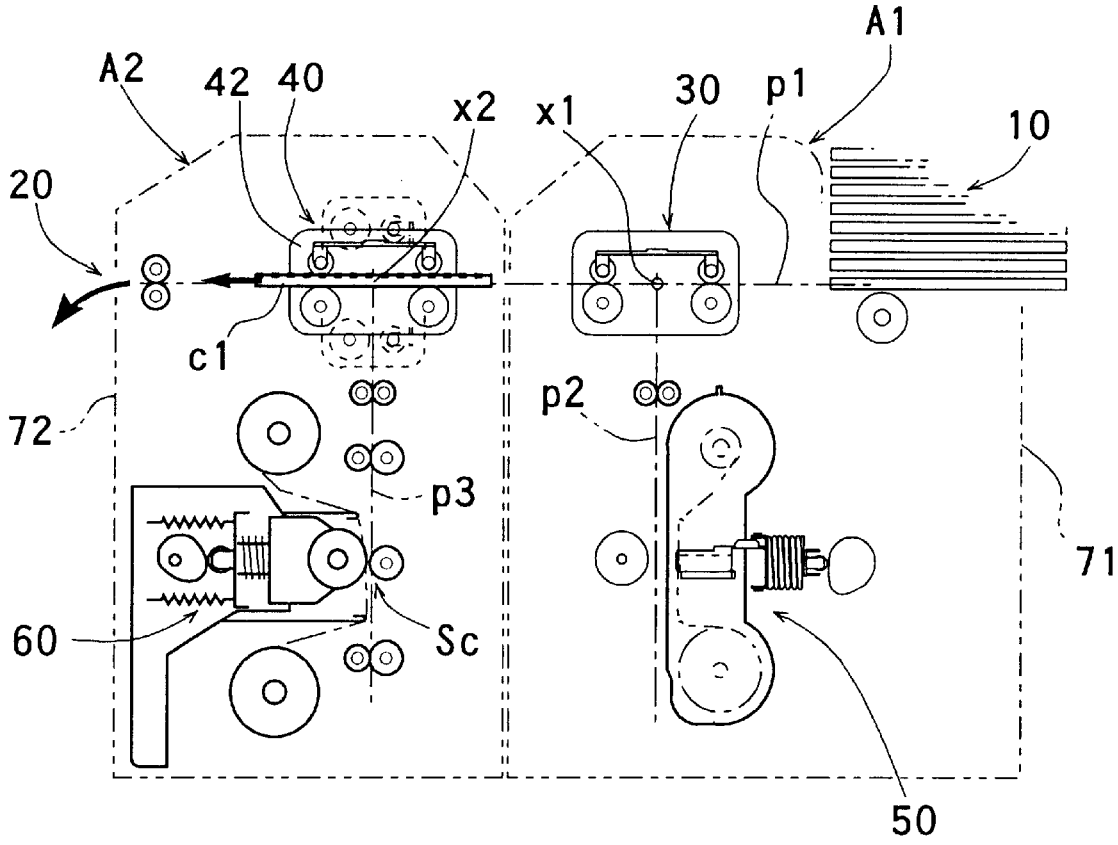

In a case where the both surfaces of the card are required to be coated with the protective film, the card in FIG. 4G may be turned 180 degrees at the second card turning means 40 and resent to the coating unit 60 as shown in FIG. 4E, in much the same manner as the information recording on both surfaces of the card as mentioned above.

As is apparent from the foregoing description, the recording device of the invention has a technically ingenious arrangement of the card transfer paths and operating components. That is, the second transfer path p2 including the first processing means (printer) 50 and the third transfer path p3 including the second processing means (coating unit) 60 are respectively arranged substantially parallel to each other and perpendicular to the first transfer path p1 including the card supplying means 10 and card discharging means 20, consequently to make the recording device compact and easy to handle.

Although the recording device of the device has a basic function of performing the recording and coating on one surface of a card, the both surfaces of the card can be processed owing to one or two card turning means as required.

Figure 5:
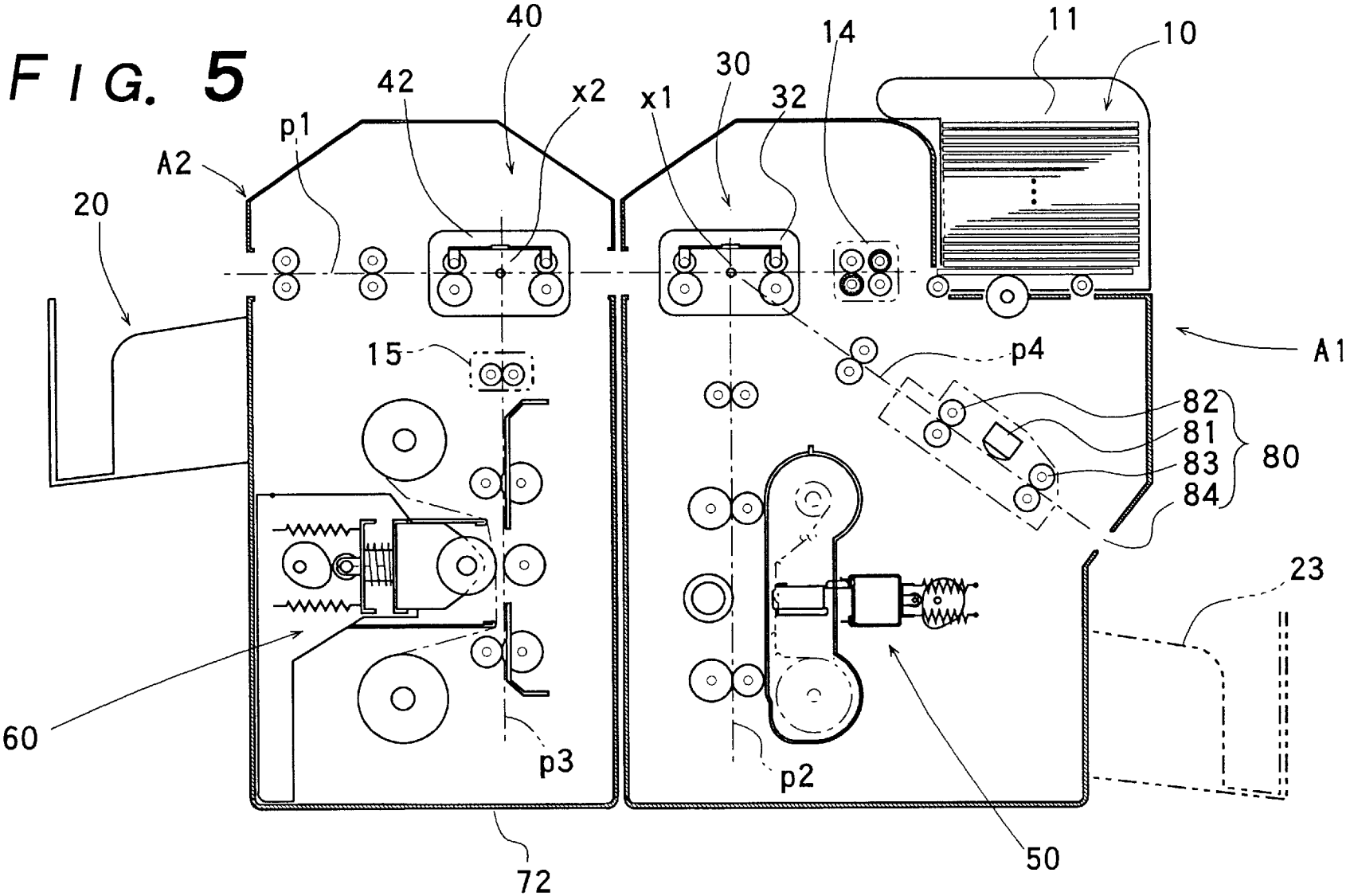
FIG. 5 is a schematic front view of a second embodiment of the device of invention.

In a second embodiment of the invention as shown in FIG. 5, a fourth transfer path p4 is provided beneath the card supplying means 10. That is, the fourth transfer path p4 extends aslant downward from the intersection x1 of the first transfer path p1 and second transfer path p2. A third processing means 80 is disposed along the fourth transfer path p4. In this embodiment, the third processing means 80 is a magnetic encoder having a data writing head 81 for magnetically recording information on a magnetic strap formed on the card such as a credit card.

The magnetic encoder of the third processing means 80 includes two sets of card transfer rollers 82 and 83 placed along the fourth transfer path p4 across the data writing head 81. These components of the third processing means 80 is by no means limited thereto. When magnetically recording information on the card, the card to be recorded is moved by driving the card transfer rollers 82 and 83 to pass through the encoder 80 several times for the purpose of performing initialization, data writing, verification and so on.

In a case of using an IC card as the recording card, a direct-contact type terminal unit of an IC writer or a non-contact type antenna may be used instead of the data writing head 81.

This second embodiment of FIG. 5 has the same arrangement of the components as the first embodiment. Namely, in the second embodiment, the first and second card turning means 30 and 40 are placed on the first transfer path p1, the first processing means 50 is placed on the second transfer path p2, and the second processing means 60 is placed on the third transfer path p3. Since the structure and function of this embodiment are identical with those of the first embodiment, the description of these components is omitted below to avoid repetition. Similarly to the first embodiment, this second embodiment uses a printer as the first processing means 50, a coating unit as the second processing means 60, and a magnetic encoder as the third processing means 80 for the convenience of description, but these components constituting the recording device are by no means limited thereto.

In the embodiment shown in FIG. 5, an aperture 84 is formed in the casing 71 on the extension of the fourth transfer path p4 so as to permit an error card to be discharged outside through the aperture 84. A card catch stacker 23 may be provided outside so as to receive the error card.

Figure 6:
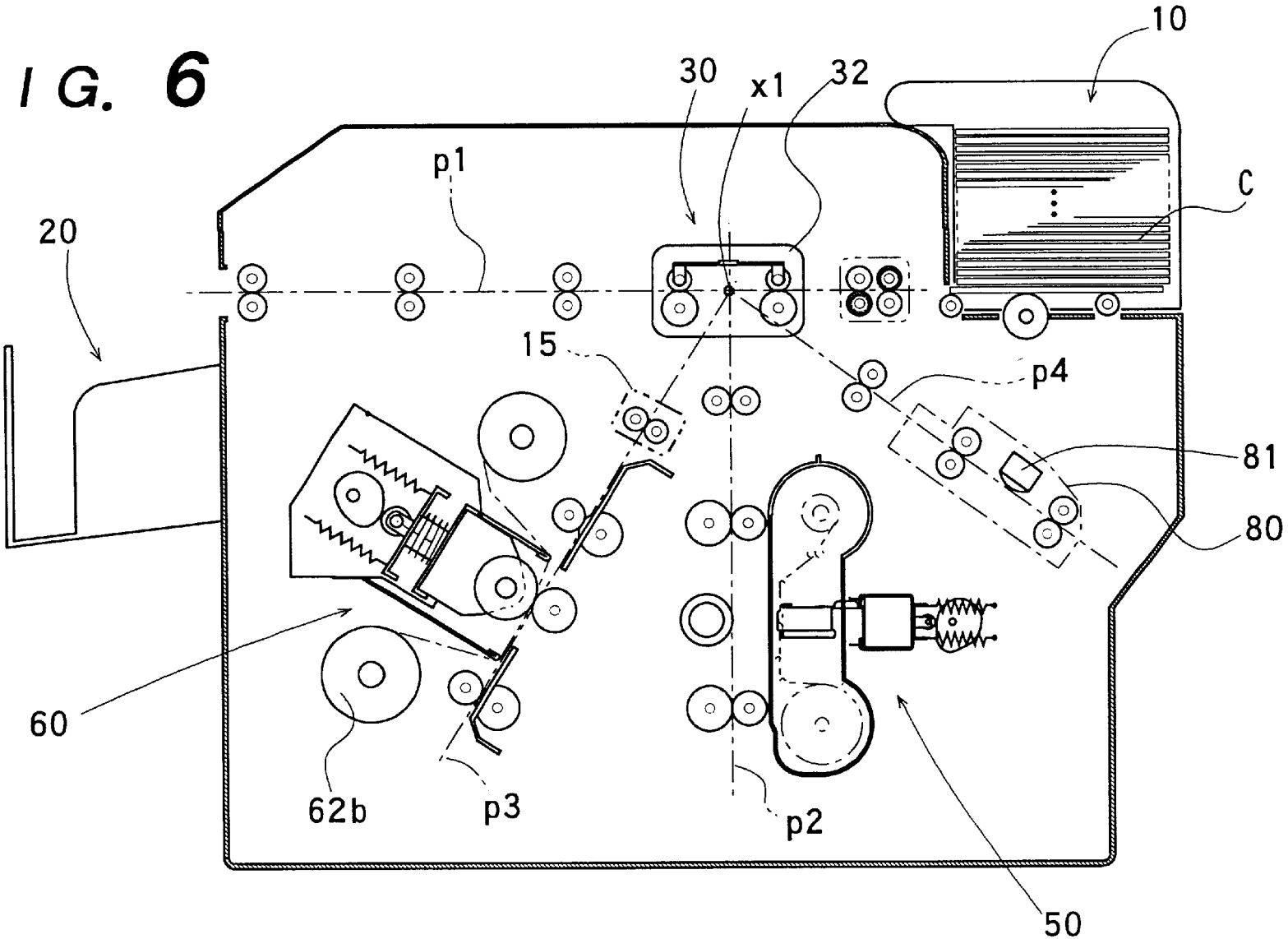
FIG. 6 is a schematic front view of a third embodiment of the device of the invention.

A third embodiment shown in FIG. 6 has only one card turning means 30 placed on the first card transfer path p1. No secondary card turning means as seen in the foregoing embodiments is provided in this embodiment. First, second, third and fourth card transfer paths p1, p2, p3 and p4 in this embodiment intersect at the rotational axis (intersection x1) of the card turning means 30. That is, these card transfer paths p1, p2, p3 and p4 extend radially from the intersection x1.

In this embodiment, the first processing means 50 is placed on the second transfer path p2, the second processing means 60 is placed on the third transfer path p3, and the third processing means 80 is placed on the fourth transfer path p4. Also in this embodiment, there are used a printer as the first processing means 50, a coating unit as the second processing means 60, and a magnetic encoder as the third processing means 80 for the convenience of description, but these components constituting the recording device are by no means limited thereto.

Figure 7:
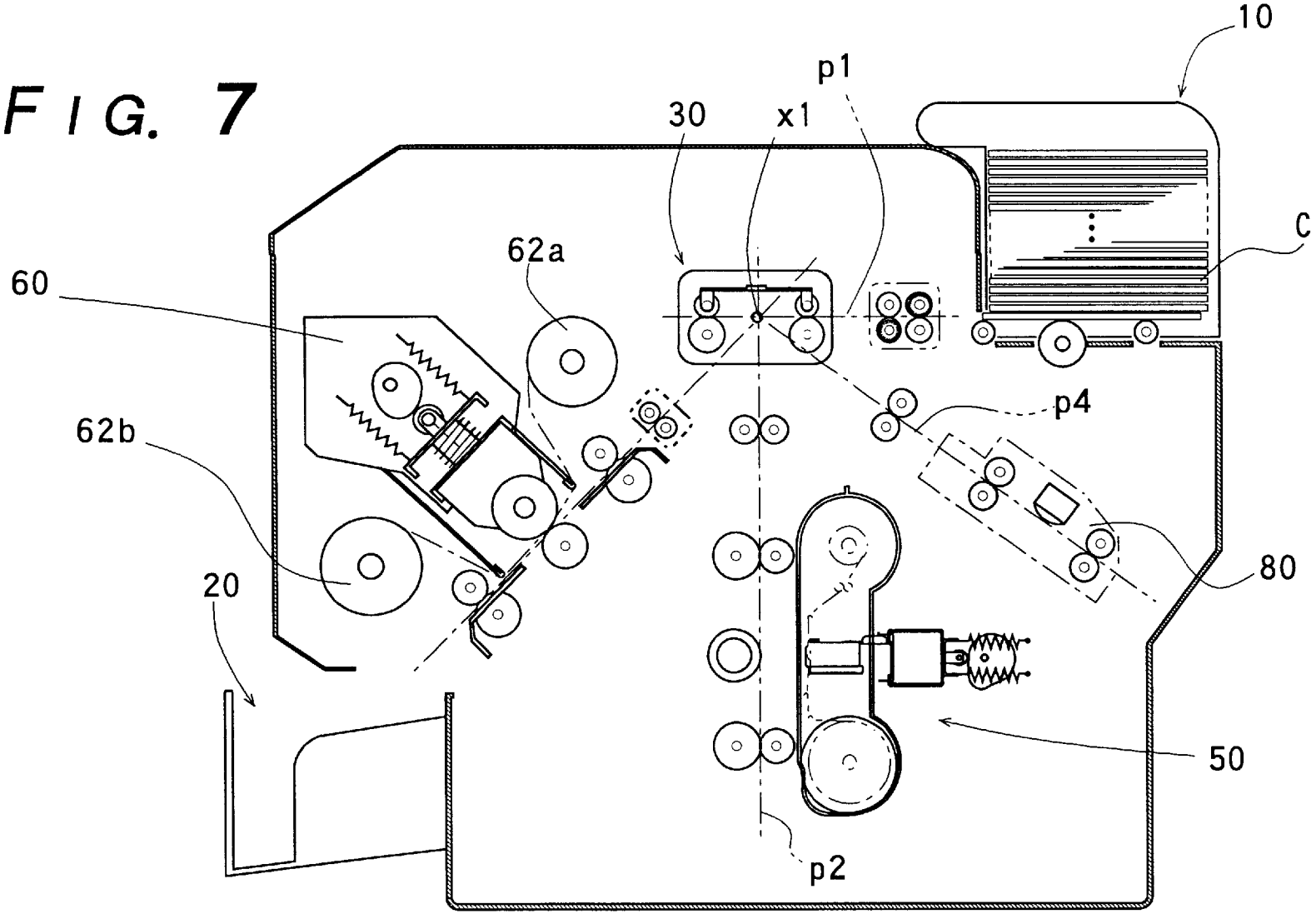
FIG. 7 is a schematic front view of a fourth embodiment of the device of the invention.

A fourth embodiment shown in FIG. 7 has the card discharging means 20 placed outside on the extension of the third card transfer path p3. According to this embodiment, after information data are recorded at the first processing means 50 and/or third processing means 80 and a protective film is coated on a card, the card can be forwarded along the second transfer path p2 and discharged to the card discharging means 20 without returning to the first transfer path p1.

The embodiment of FIG. 7 has the first to fourth transfer paths p1–p4 extending radially from the rotational axis (intersection x1) of the card turning means 30 similarly to the third embodiment of FIG. 6. Accordingly, since the structure and function of this fourth embodiment are identical with those of the third embodiment, the description of these components is omitted below to avoid repetition.

Figure 8:
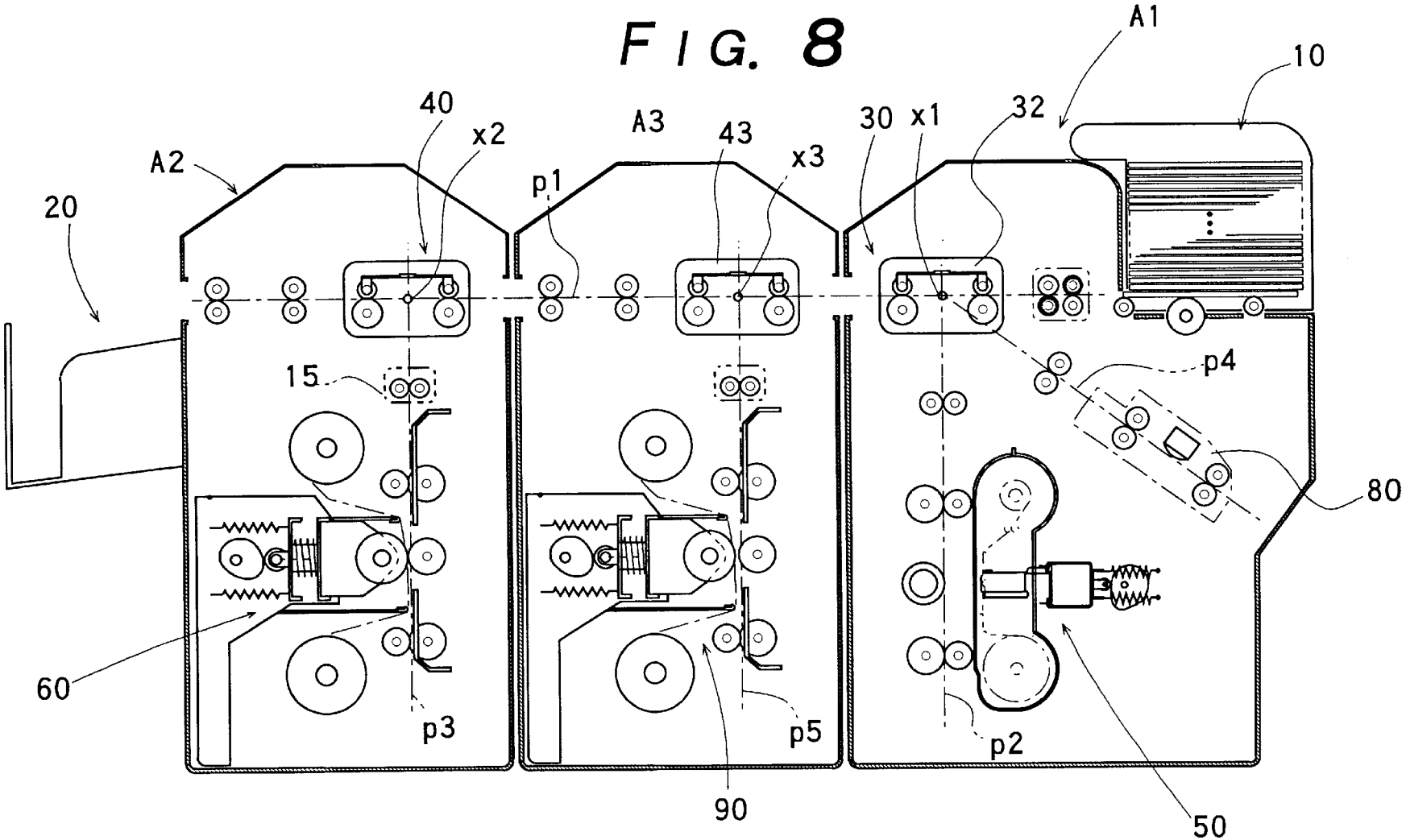
FIG. 8 is a schematic front view of a fifth embodiment of the device of the invention.

A fifth embodiment shown in FIG. 8 includes a third device unit A3 equivalent to the second device unit A2 in the second embodiment of FIG. 5, which is placed between the first device unit A1 and the second device unit A2. That is, the third device unit A3 has a fifth transfer path p5 intersecting with the common first transfer path p1 passing through the first and second device units A1 and A2, a third card turning means 43 located at the intersection x3 of the first and fifth transfer paths p1 and p5, and a fourth processing means 90 on the fifth transfer path p5.

The third card turning means 43 in the third device unit A3 has the same structure and function as the second card turning means 40. The fourth processing means 90 in this embodiment is a coating unit for coating a card with a protective film, which is identical with the coating unit in the second processing means 60 of the second device unit A2. Also, the other components in this third device unit A3 are also much the same as those in the second device unit A2. Therefore, the description of these components is omitted below.

This embodiment having two coating units 60 and 90 makes it possible to coat the recording card with two coating films having different materials, colors or patterns, consequently to broaden the applications of the recording device.

A card printer according to this embodiment can various functions. For instance, the first processing means 50 may be a thermal fusing type printer adapted for printing a binary image such as a letter, and the fourth processing means 90 may be a sublimation type printer adapted for printing a multi-gradation image such as a photograph and vice versa. As another measure, there may be used a color printer as the first processing means 50 and a monochrome printer as the fourth processing means 90 and vice versa.

Figure 9:
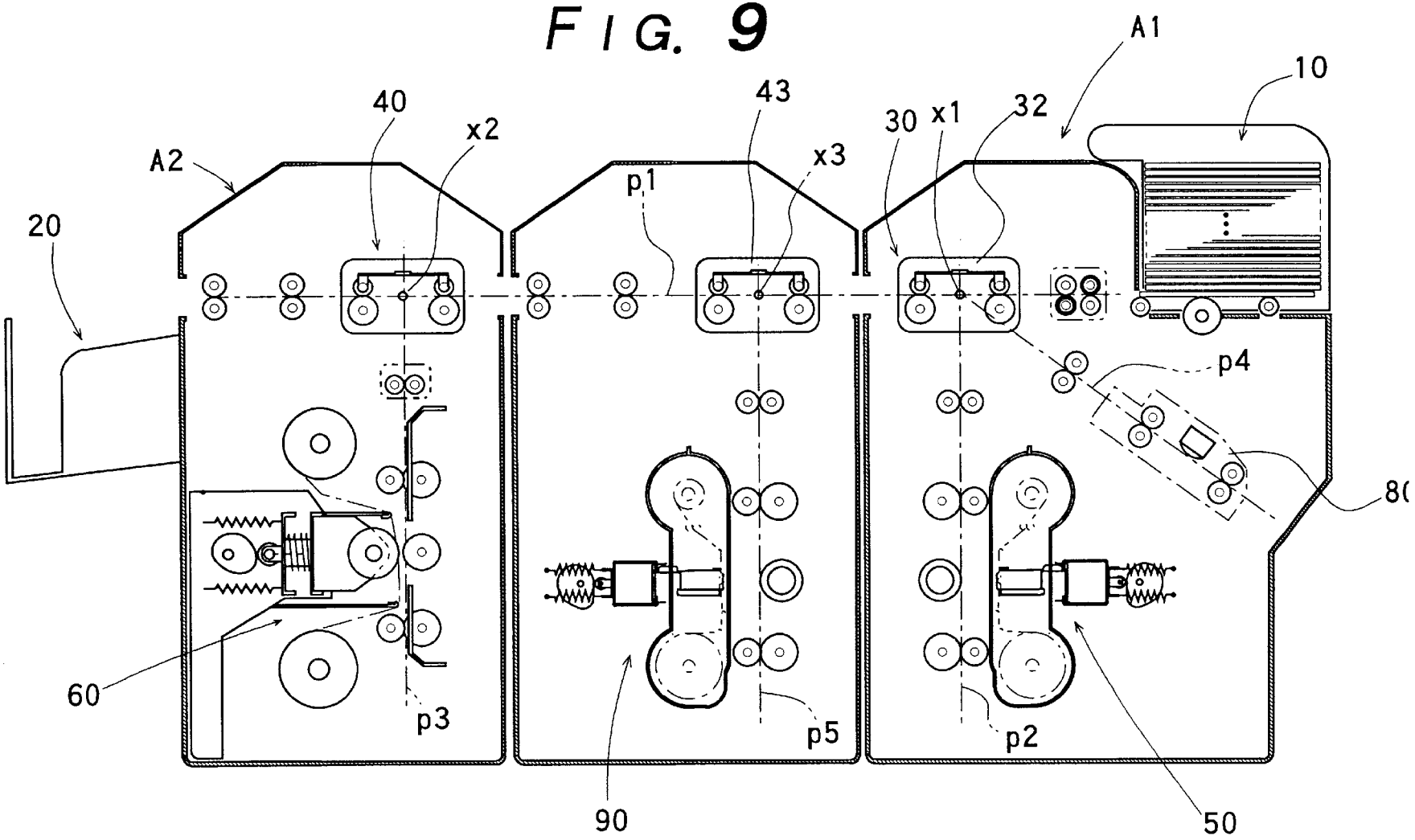
FIG. 9 is a schematic front view of a seventh embodiment of the device of the invention.

As seen from the embodiment illustrated in FIG. 8 and FIG. 9, the recording device of the invention has two or more card transfer paths intersecting with the common first transfer path, along which the processing means required for recording information on a card are arranged rationally, so that it can be developed to perform various functions according to the purposes for which it is used. Thus, the number and type of the processing means placed along the card transfer path or paths intersecting with the first transfer path are by no means limited. The processing means may be respectively disposed within separate casings or one or more common casings.

As is apparent from the foregoing description, the recording device according to this invention is provided with the second and third transfer paths, and optionally with the fourth and fifth transfer paths, which paths intersect with the first transfer path at one or more intersections so as to transfer a recording card to among the transfer paths. This recording device can therefore be made compact rationally, and handle effectively the recording card at the required processing means.

Specifically, since the card recording device of the invention has the first and second processing means formed of the card printer and coating unit and arranged rationally on the second and third transfer paths intersecting with the first transfer path, the recording device can be made compact without degrading its performance and ability of transferring and processing the recording card. Since the card turning means is placed at the intersection of the card transfer paths, coating and printing can be stably effected on either or both of the surfaces of the recording card with simple driving and controlling mechanisms.

Furthermore, the card recording device of the invention comprises the card supplying means for storing recording cards, card printer unit for printing information data on the card and various processing means such as the magnetic encoder, which are rationally incorporated in one casing, and further comprises other processing means such as the coating unit incorporated in another casing. Thus, the most versatile information card producing system having a wide range of applications can be constructed with ease.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is:

1. A recording device comprising a first transfer path having a card supplying means for storing one or more cards, a second transfer path intersecting with said first transfer path, a third transfer path intersecting with said first transfer path p1, a first card turning means placed at one or more intersections at which said first and/or second transfer paths intersect with each other, a first processing means placed on said second transfer path, and a second processing means placed on said third transfer path.

2. A recording device as claimed in claim 1, wherein said first transfer path is provided at its one end with said card supplying means and at its other end with a card discharging means.

3. A recording device as claimed in claim 1, wherein said second or third transfer path is provided at one end with a card discharging means.

4. A recording device as claimed in claim 1, wherein said second transfer path intersects with said first transfer path at a first intersection, and said third transfer path intersects with said first transfer path at a second intersection, and said card turning means are disposed at said first and second intersection, respectively.

5. A recording device as claimed in claim 1, wherein at least one of said second and third transfer paths intersects with said first transfer path at right angles.

6. A recording device as claimed in claim 1, wherein said second and third transfer paths intersect with said first transfer path at one intersection, and said card turning means is placed at said one intersection.

7. A recording device as claimed in claim 1, wherein said first and second processing means are incorporated in one casing.

8. A recording device as claimed in claim 1, wherein said first and second processing means are incorporated respectively in separate casings capable of being united detachably with each other.

9. A recording device as claimed in claim 1, wherein one of said first and second processing means is a thermal transfer printer, and the other processing means is a coating unit for coating the card with a coating film.

10. A recording device as claimed in claim 1, further comprising a fourth transfer path intersecting with said first transfer path, said fourth transfer path being provided with a third processing means.

11. A recording device as claimed in claim 10, wherein said fourth transfer path extends from said intersection of said first and second transfer paths.

12. A recording device as claimed in claim 10, wherein said first, second and third processing means each are one selected from a thermal transfer printer, a coating unit for coating the card with a coating film, and a magnetic encoder.

13. A recording device as claimed in claim 10, further comprising a fifth transfer path intersecting with said first transfer path, said fifth transfer path being provided with a fourth processing means.

14. A recording device as claimed in claim 13, wherein said first, second, third and fourth processing means each are one selected from a thermal transfer printer, a coating unit for coating the card with a coating film, and a magnetic encoder.

15. A recording device as claimed in claim 13, wherein said second, third and fifth transfer paths each intersect with said first transfer path at right angles, respectively.

16. A recording device as claimed in claim 13, wherein said first processing means is incorporated in a first casings, said second processing means is incorporated in a second casings, and said fourth processing means is incorporated in a third casings, said first, second and third casing being capable of being united detachably.

* * * * *